US007900544B2

(12) United States Patent
Williams

(10) Patent No.: US 7,900,544 B2
(45) Date of Patent: Mar. 8, 2011

(54) COMBINATION FOOD PREPARATION DEVICE

(76) Inventor: Collis H. Williams, Tallahassee, FL (US)

( * ) Notice: Subject to any disclaimer, the term of this patent is extended or adjusted under 35 U.S.C. 154(b) by 1088 days.

(21) Appl. No.: 11/265,840

(22) Filed: Nov. 3, 2005

(65) Prior Publication Data

US 2007/0095189 A1 May 3, 2007

(51) Int. Cl.
*B26D 11/00* (2006.01)

(52) U.S. Cl. ..... 83/865; 83/435.16; 83/425; 83/425.1; 83/404; 83/407

(58) Field of Classification Search ..... 83/932, 83/865, 435.16, 437.2, 356.3, 425.1, 425, 83/404, 404.1, 404.4, 407, 408, 708, 167, 83/651.1, 856, 857, 858, 403.3, 707, 431, 83/435.15; 241/94, 95, 274, 282.1, 283; 30/114, 117, 280, 304, 315; D7/673, 674
See application file for complete search history.

(56) References Cited

U.S. PATENT DOCUMENTS

| | | | | | |
|---|---|---|---|---|---|
| 810,998 | A | * | 1/1906 | Thomas | 83/408 |
| 1,046,551 | A | * | 12/1912 | Cass | 83/408 |
| 1,122,501 | A | * | 12/1914 | Hills | 83/356.2 |
| 1,907,602 | A | * | 5/1933 | Spang | 452/148 |
| 2,026,691 | A | | 1/1936 | McArdle et al. | |
| 2,303,595 | A | * | 12/1942 | Young | 83/404.2 |
| 2,353,607 | A | * | 7/1944 | Young | 83/404.2 |
| 2,473,165 | A | * | 6/1949 | McKinney | 83/167 |
| 2,661,039 | A | * | 12/1953 | Davis et al. | 99/513 |
| 2,698,038 | A | * | 12/1954 | Polkosnik | 83/697 |
| 2,924,256 | A | * | 2/1960 | Reiland | 83/404.3 |
| 3,883,079 | A | * | 5/1975 | Papai | 241/94 |
| 3,890,867 | A | * | 6/1975 | Wilson | 83/404 |
| 4,381,687 | A | | 5/1983 | Reifenhauser | |
| 4,579,028 | A | | 4/1986 | Neidhardt | |
| 4,646,602 | A | * | 3/1987 | Bleick | 83/408 |
| 4,763,574 | A | * | 8/1988 | Ast | 100/98 R |
| 5,207,137 | A | * | 5/1993 | Baril | 83/167 |
| 5,249,494 | A | | 10/1993 | Borvitz | |
| 5,410,929 | A | * | 5/1995 | Wallace | 83/160 |
| 5,478,018 | A | | 12/1995 | Wang | |
| 5,482,166 | A | | 1/1996 | Brown | |
| 5,765,472 | A | * | 6/1998 | Kim | 99/537 |
| 5,784,936 | A | * | 7/1998 | King | 83/145 |
| 5,927,625 | A | * | 7/1999 | Simpson et al. | 241/84 |
| 5,983,769 | A | | 11/1999 | Schneider | |

* cited by examiner

*Primary Examiner* — Boyer D Ashley
*Assistant Examiner* — Omar Flores-Sánchez
(74) *Attorney, Agent, or Firm* — John Wiley Horton

(57) ABSTRACT

A combination slicing and dicing food processing device. The device generally includes a cutting box and gliding body which travels back and forth across the cutting box. The gliding body features a food cradle that is configured to hold a food product which is to be processed. The food cradle is attached on one end of a principal cutting arm and a handle is attached to the other end of the principal cutting arm. A secondary cutting arm is provided beneath and attaching to the principal cutting arm. A ram is provided on the end of the secondary cutting arm and positioned slightly behind the food cradle so that the rain trails the food cradle as the food gliding body travels back and forth across the cutting box. The cutting box includes a principal cutting blade near one end and a process slot for receiving slices of the food product which are sliced off by the principal cutting blade. The slices are received in a collapsing bin in front of the ram before they are finally processed by a dicing card or julienne cutting card and received in a receiving bin.

6 Claims, 11 Drawing Sheets

COMBINATION FOOD PREPARATION DEVICE

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of food preparation devices. More specifically the present invention comprises a combination slicing and dicing device for processing food.

2. Description of the Related Art

Many food processing devices for producing sliced and diced food products are known in the prior art. These devices come in many different designs and configurations. One example of such a device is described in U.S. Pat. No. 2,026,691 to McArdle et al. (1936). McArdle et al. describes a cutting machine for selectively slicing, shredding, and dicing vegetables. The McArdle et al. device utilizes a food pusher and a cutting plate attached to a spindle so that when a user turns a handle, the cutting plate spins and the food pusher travels toward the cutting plate.

Another processing device is exemplified by U.S. Pat. No. 4,381,687 to Reifenhauser (1983). Reifenhauser discloses a cutting device for cubing meat products. The Reifenhauser device utilizes a hopper to feed meat products in front of a rough-pressing die which pushes the meat through a series of knives. The meat is first cut into strips and is then cut into cubes.

While these devices may be well suited for a narrow range of applications, they are poorly suited for others. For example, McArdle et al.'s device would be poorly suited to cut meats and Reifenhauser's device would be poorly suite to cut vegetables. Additionally, McArdle et al.'s device requires the user to repeatedly turn the handle to process a length of vegetables. The device must then be unspooled by turning the handle in the opposite direction before it can be used again. This process is very laborious and can quickly cause the user to become fatigued.

It is therefore desirable to provide a processing device that can be used to cut both meats and vegetables and is easy to use.

BRIEF SUMMARY OF THE INVENTION

The present invention comprises a combination slicing and dicing food processing device. The device generally includes a cutting box and gliding body which travels back and forth across the cutting box. The gliding body features a food cradle that is configured to hold a food product which is to be processed. The food cradle is attached on one end of a principal cutting arm and a handle is attached to the other end of the principal cutting arm. A secondary cutting arm is provided beneath and attaching to the principal cutting arm. A ram is provided on the end of the secondary cutting arm and positioned slightly behind the food cradle so that the ram trails the food cradle as the food gliding body travels back and forth across the cutting box. The cutting box includes a principal cutting blade near one end and a process slot for receiving slices of the food product which are sliced off by the principal cutting blade. The slices are received in a collapsing bin in front of the ram before they are finally processed by a dicing card or julienne cutting card and received in a receiving bin.

REFERENCE NUMERALS IN THE DRAWINGS

| | | | |
|---|---|---|---|
| 10 | food processing device | 12 | cutting box |
| 14 | gliding body | 16 | principal cutting arm |
| 18 | secondary cutting arm | 20 | food cradle |
| 22 | handle | 24 | gliding slot |
| 26 | process slot | 28 | principal cutting blade |
| 30 | dicing blade | 32 | dicing card |
| 34 | ram | 36 | collapsing bin |
| 38 | receiving bin | 40 | card frame |
| 42 | vertical cutting blades | 44 | horizontal cutting blades |
| 46 | julienne card | 48 | ram sleeve |
| 50 | arm slot | 52 | ram face |
| 54 | block | 56 | processed product |
| 58 | sliced product | 60 | blade mating grooves |
| 62 | motor shaft | 64 | motor housing |
| 66 | switch | 68 | electrical plug |

DETAILED DESCRIPTION OF THE INVENTION

Figure 1:
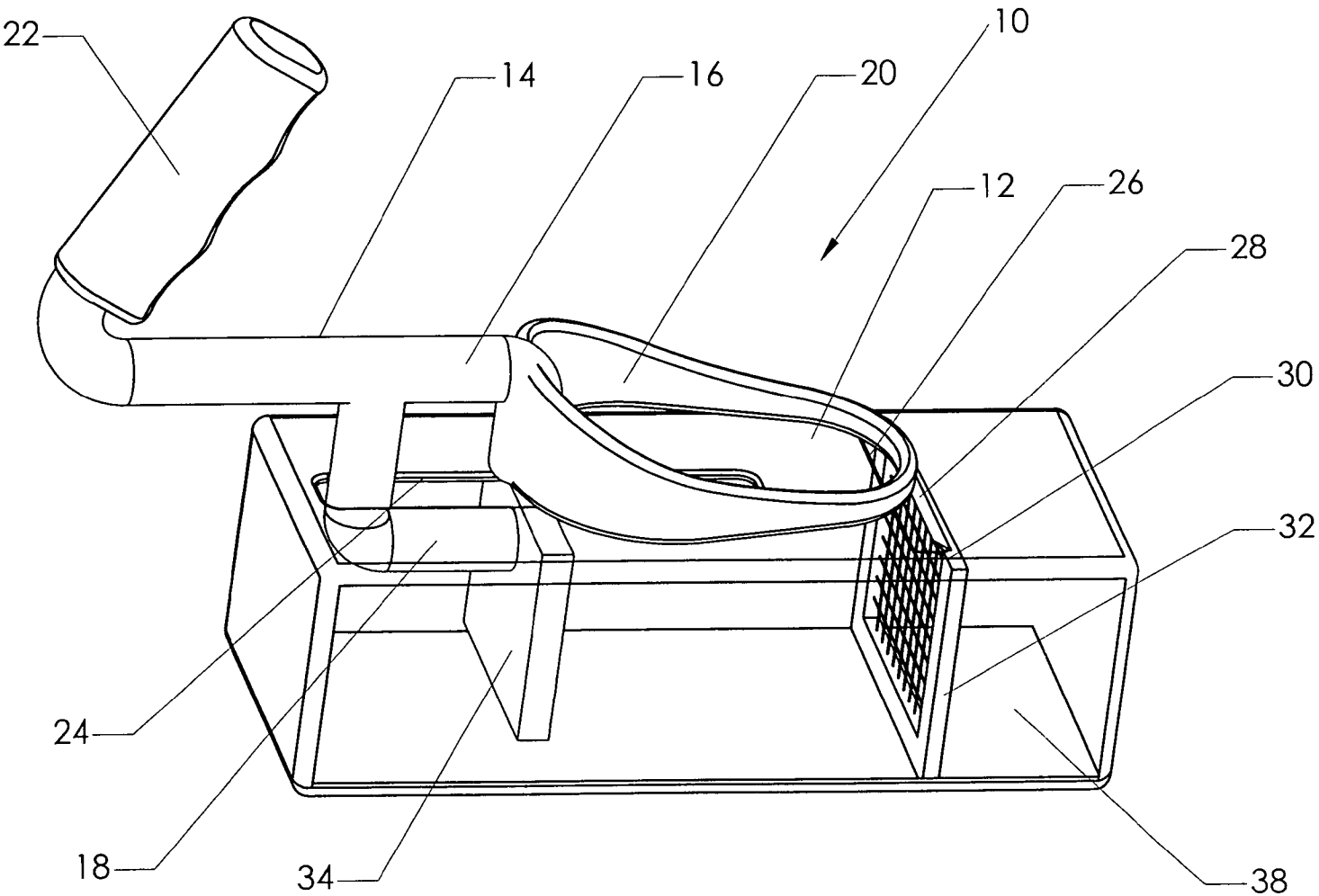
FIG. 1 is a perspective view, showing the present invention.

The present invention, combination food processing device 10, is shown in FIG. 1. Food processing device 10 includes cutting box 12 and gliding body 14. Gliding body 14 includes principal cutting arm 16 and secondary cutting arm 18, which is attached below principal cutting arm 16. Food cradle 20 is attached to one end of principal cutting arm 16 and handle 22 is the other end. Food cradle 20 is configured to hold a food product such as a block of meat or cheese. Food cradle 20 can take many forms, but the bottom of food cradle 20 is open so that the food product can rest against the top of cutting box 12. Handle 22 is attached to the opposite end of principal cutting arm 16. Handle 22 can also take many forms, but handle 22 is configured to enable the user of food processing device 10 to grip gliding body 14 and slide gliding body 14 back and forth across cutting box 12.

Secondary cutting arm 18 is attached beneath principal cutting arm 16 and is received within the interior of cutting box 12 through gliding slot 24. Ram 34 is attached to the other end of secondary cutting arm 18. Gliding slot 24 is an elongated cutout which is configured to receive secondary cutting arm 18 and permit gliding body 14 to travel a fixed distance in a forward and backward direction with respect to cutting box 12.

In the preferred embodiment, cutting box 12 is a rectangular box. Principal cutting blade 28 is provided on the top of cutting box 12. Principal cutting blade 28 is illustrated as a simple straight, stationary blade in FIG. 1, but it is understood that principal cutting blade 28 can be any sort of device configured for slicing food products. As another example, principal cutting blade 28 can also be a circular blade that is rotationally driven by a motor. Process slot 26 is placed in front of principal cutting blade 28 to receive portions of food which are sliced off by principal cutting blade 28 as will be explained in greater detail subsequently.

A secondary cutting means is provided within the interior of cutting box 12 for further processing the portion of food sliced off by principal cutting blade 28. In FIG. 1, dicing card 32 with dicing blade 30 is shown. Dicing card 32 is removably attached within cutting box 12 to facilitate cleaning and allow for food processing device 10 to be used for different processing applications as will be explained subsequently. Dicing card 32 can be inserted and removed through a slot provided in the side of cutting box 12. Receiving bin 38 is provided on the side of dicing card 32 opposite ram 34. Receiving bin 38 receives processed food after it has passed through the secondary cutting means. Receiving bin 38 can be made detachable so that the processed food product can be easily transported. The floor can also be removed from receiving bin 38 so that the processed food product can pass straight through to a storage container placed underneath.

Figure 2:
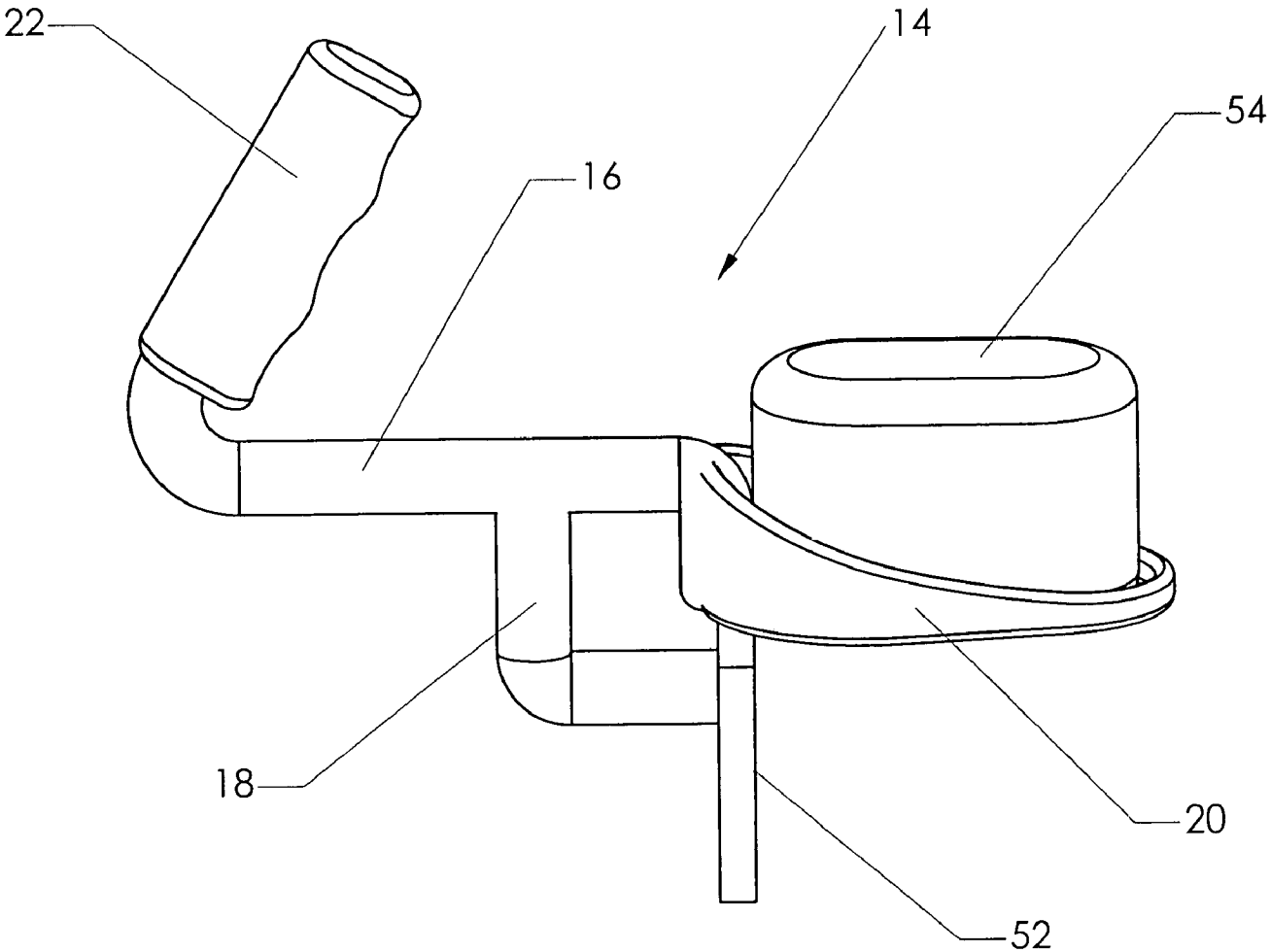
FIG. 2 is a perspective view, showing a gliding body.

FIG. 2 shows a detail view of gliding body 14. Gliding body 14 is holding block 54 in food cradle 20. Block 54 can be any product, such as a block of cheese or meat. The reader will appreciate that secondary cutting arm 18 is used to position ram face 52 slightly behind food cradle 20 for purposes that will be explained subsequently. The reader will also appreciate that since principal cutting arm 16 and secondary cutting arm 18 are attached to each other, food cradle 20 and ram face 52 move together in unison when gliding body 14 travels back and forth across cutting box 12.

Figure 3:
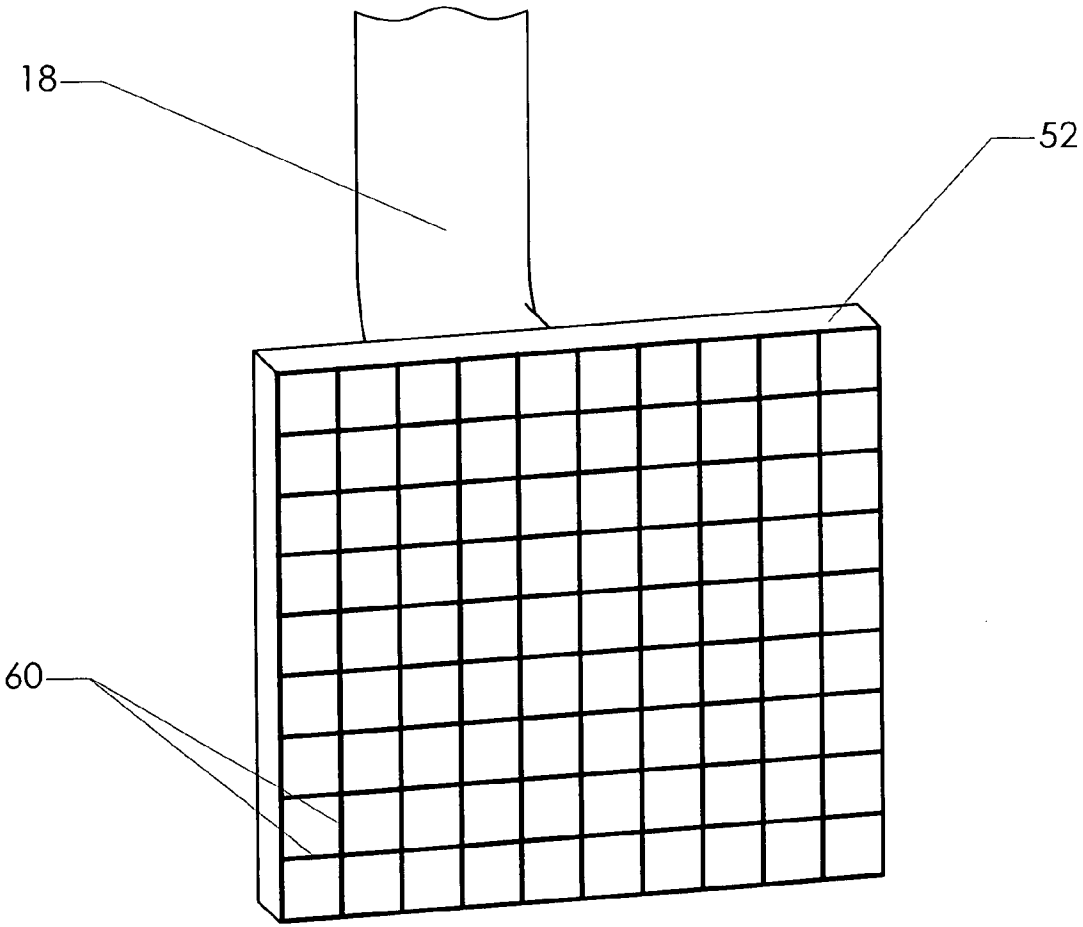
FIG. 3 is a perspective view, showing a ram.

FIG. 3 shows a detail view of ram face 52. Ram face 52 has a series of blade mating grooves 60. Blade mating grooves 60 allow the blades of the secondary cutting means to mate with ram face 52 for a cleaner cut. The reader will appreciate that the tips of the cutting blades cross over the plane of ram face 52 and are received within blade mating grooves 60 when ram 34 is pressed into the secondary cutting means.

Figure 4:
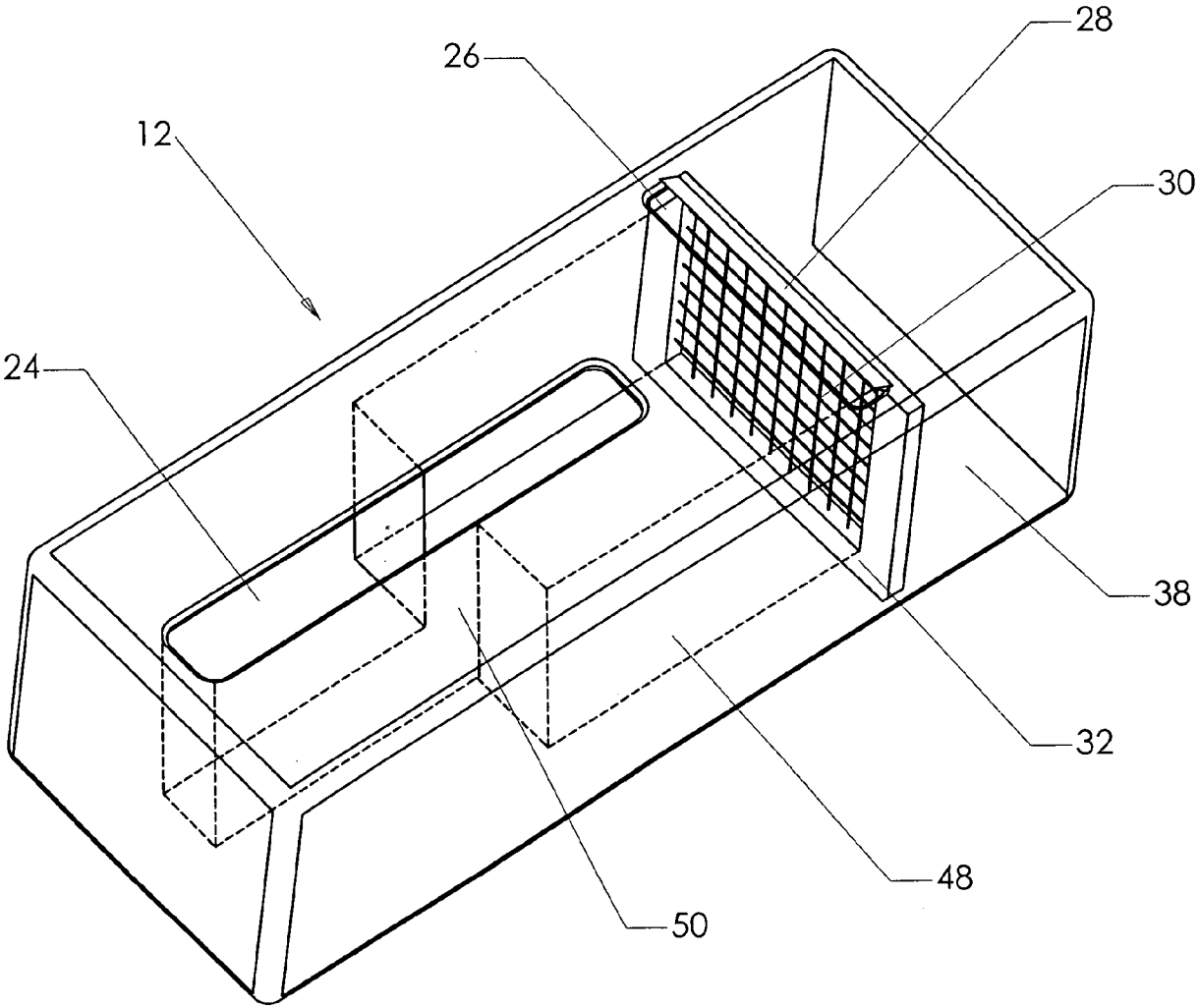
FIG. 4 is a detail view, showing a cutting box.

Cutting box 12 is illustrated in greater detail in FIG. 4. Cutting box 12 features principal cutting blade 28 which is configured to slice off a portion of block 54 when block 54 travels across principal cutting blade 28 in one direction. Process slot 26 is provided directly in front of principal cutting blade 28 for receiving the portion of block 54 which is sliced of by principal cutting blade 28. Elongated gliding slot 24 is also provided in the top of cutting box 12 to receive secondary cutting arm 18 and allow gliding body 14 to travel a fixed distance back and forth across cutting box 12.

The interior of cutting box 12 features ram sleeve 48 which allows ram 34 to move toward and away from the secondary cutting means. Ram sleeve 48 is generally a hollow tunnel which fits relatively tightly around ram 34. Bearings and aligning features can be employed to enable ram 34 to travel smoothly through ram sleeve 48 while maintaining alignment with the cutting blades of the secondary cutting means. Arm slot 50 is provided where gliding slot 24 joins with ram sleeve 48 to permit secondary cutting arm 18 to pass through ram sleeve 48 behind ram 34.

Figure 5A:
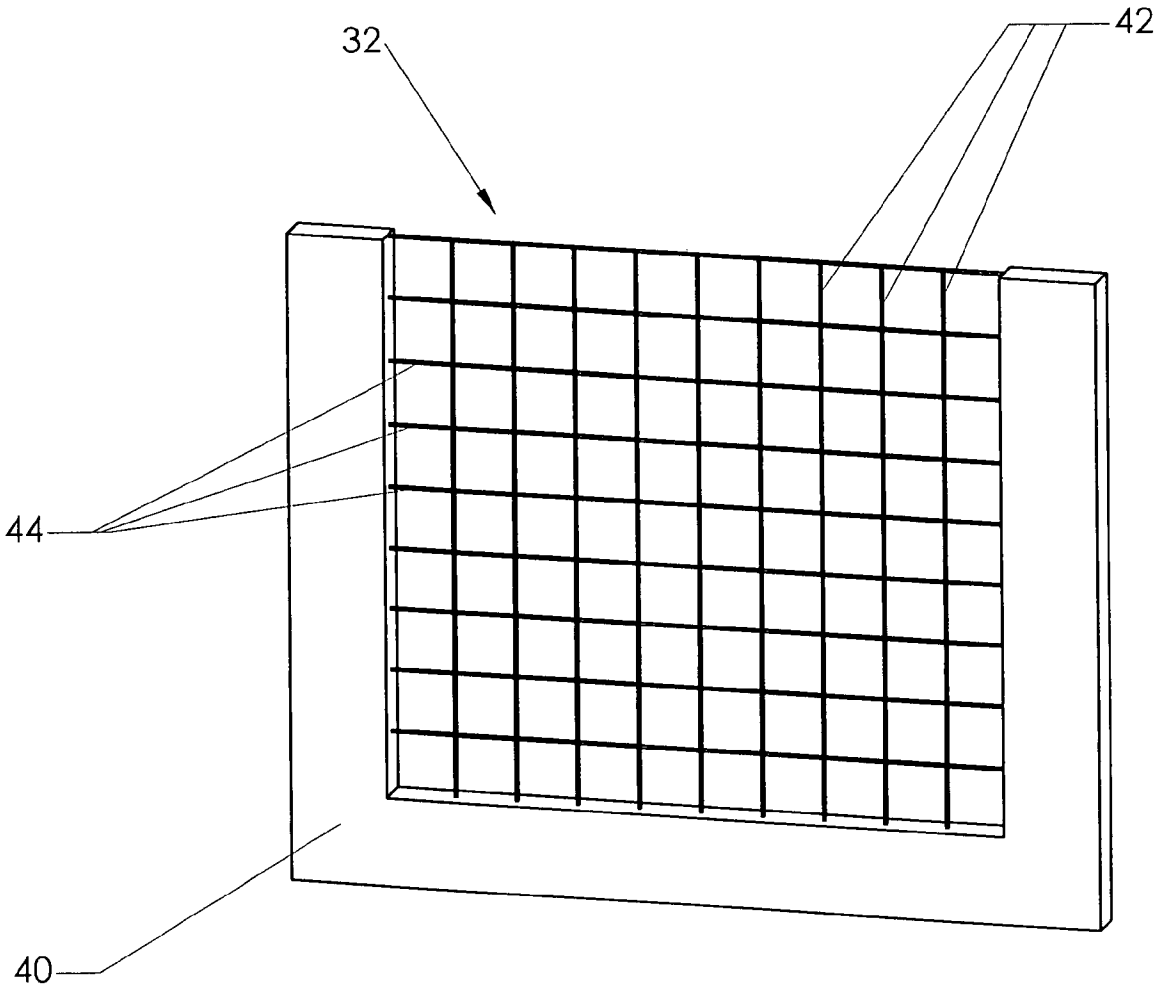
FIG. 5A is a perspective view, showing a dicing card.
Figure 5B:
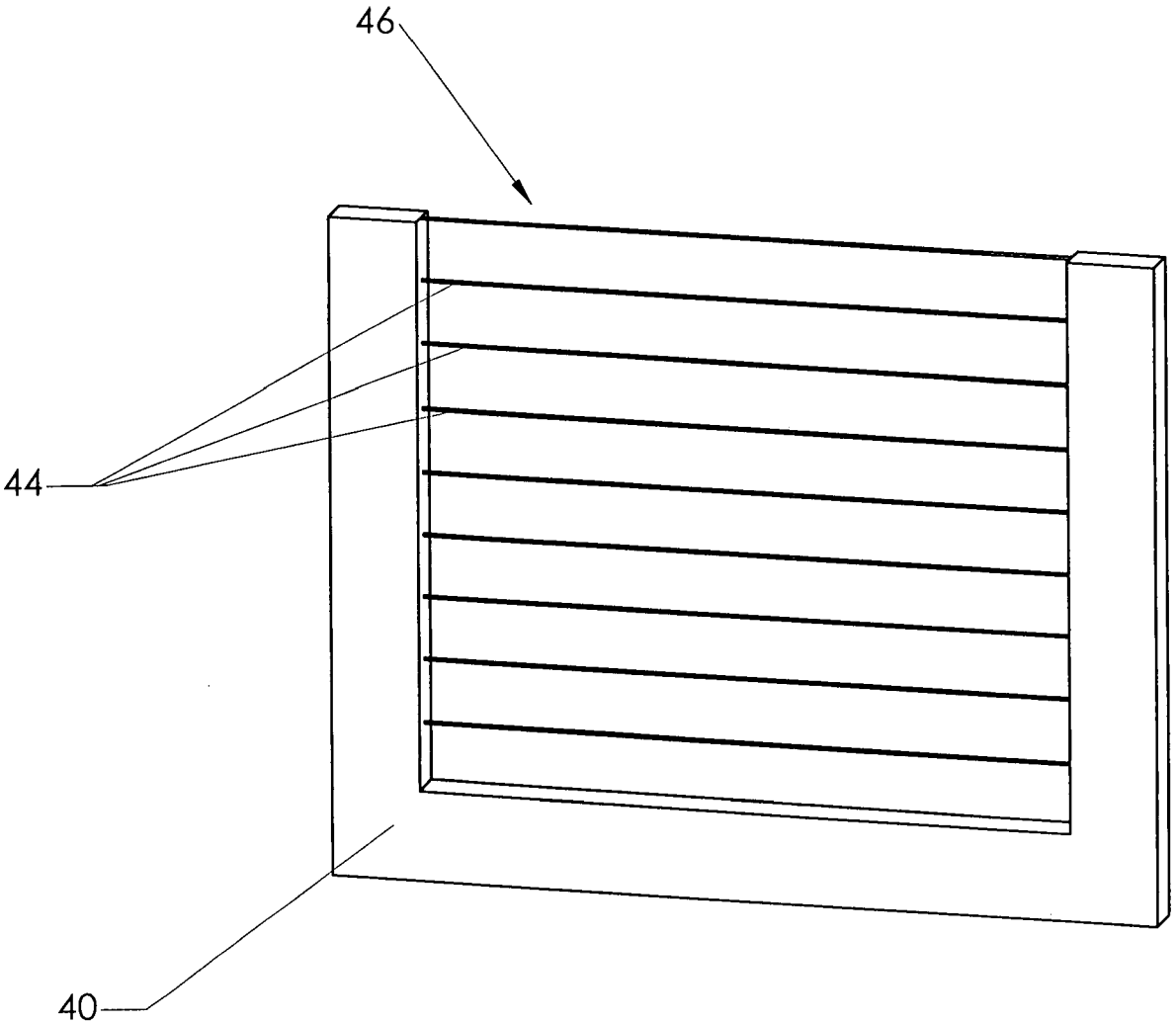
FIG. 5B is a perspective view, showing a julienne cutting card.

As described previously, the secondary cutting means is removably mounted within the interior of cutting box 12. FIGS. 5A and 5B illustrate two types of secondary cutting means that can be employed. In the preferred embodiment a removable cutting card is used to facilitate cleaning and to provide variable processing capabilities. Dicing card 32 is shown in FIG. 5A. Dicing card 32 includes a set of vertical cutting blades 42 and horizontal cutting blades 44 which are arranged in substantially perpendicular orientation with respect to each other. Vertical cutting blades 42 and horizontal cutting blades 44 can be any means adapted for cutting including sharpened blades, wire or string. Dicing card 32 also includes card frame 40 which borders the cutting blades on three sides. The reader will appreciate that cutting blades span the width and height of ram sleeve 48 so that all product that is received in front of ram 34 is pushed through the secondary cutting means. Julienne card 46, as illustrated in FIG. 5B can also be provided to process the food product into strips. Julienne card 46 is essentially the same as dicing card 32 except, the card only includes horizontal cutting blades 44.

Figure 6:
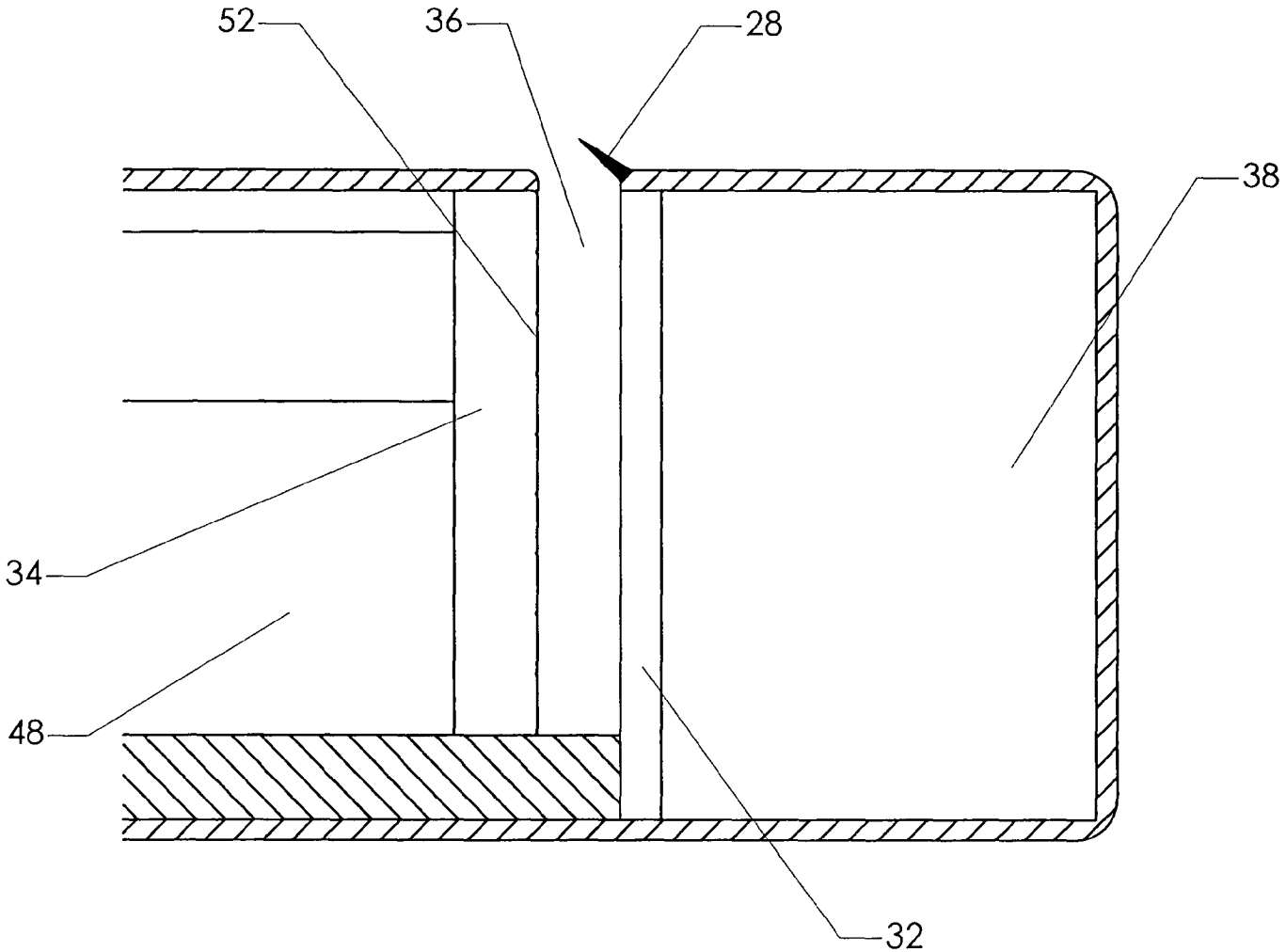
FIG. 6 is a section view, showing the present invention.

A section view of the present invention is shown in FIG. 6 to better illustrate the functionality of the secondary cutting means. As illustrated in FIG. 6, dicing card 32 is situated beneath principal cutting blade 28 and separates ram sleeve 48 from receiving bin 38. Collapsing bin 36 is created between ram face 52 and dicing card 32 as ram 34 moves in the direction of dicing card 32 through ram sleeve 48.

Figure 7:
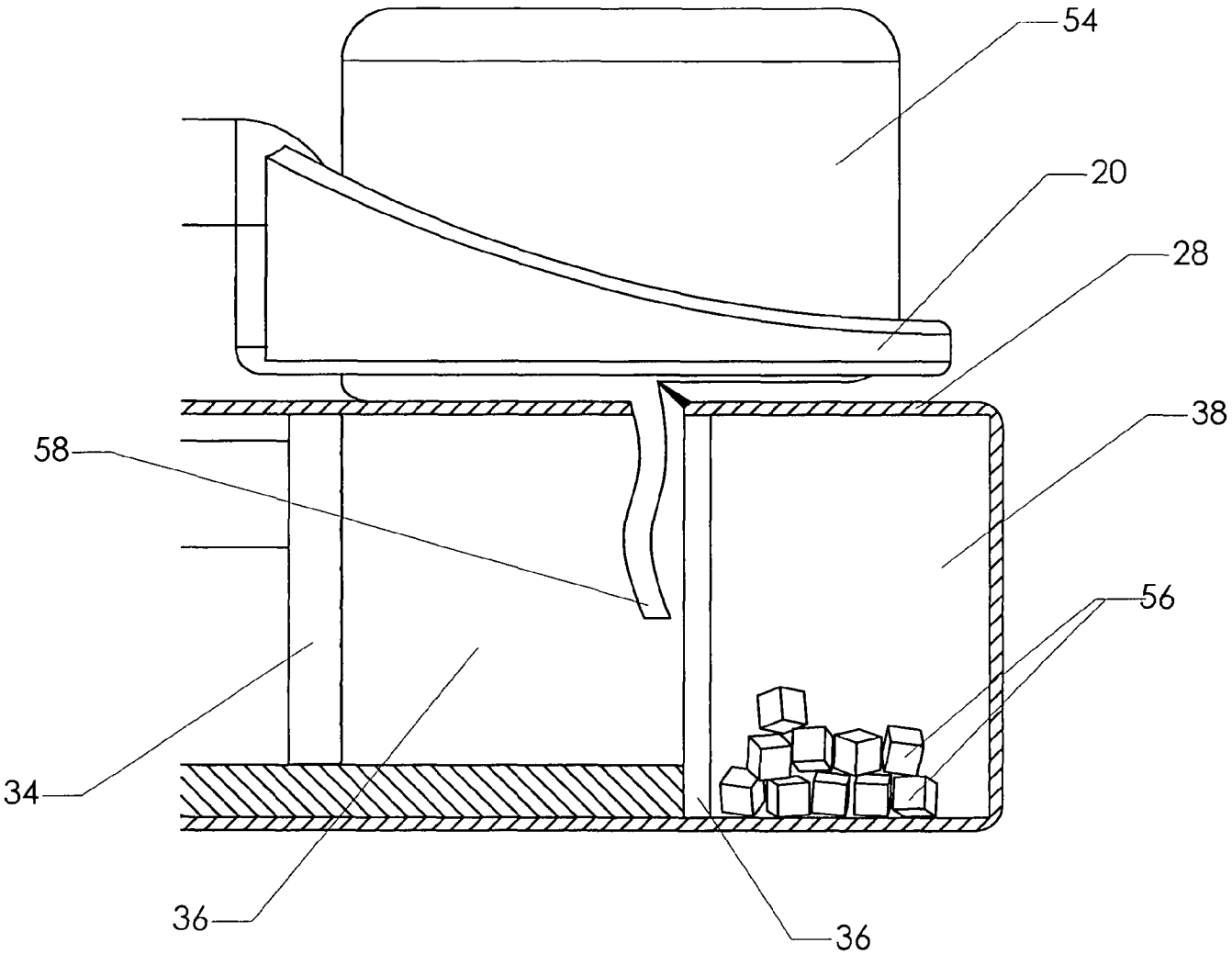
FIG. 7 is a section view, showing the present invention in use.
Figure 8:
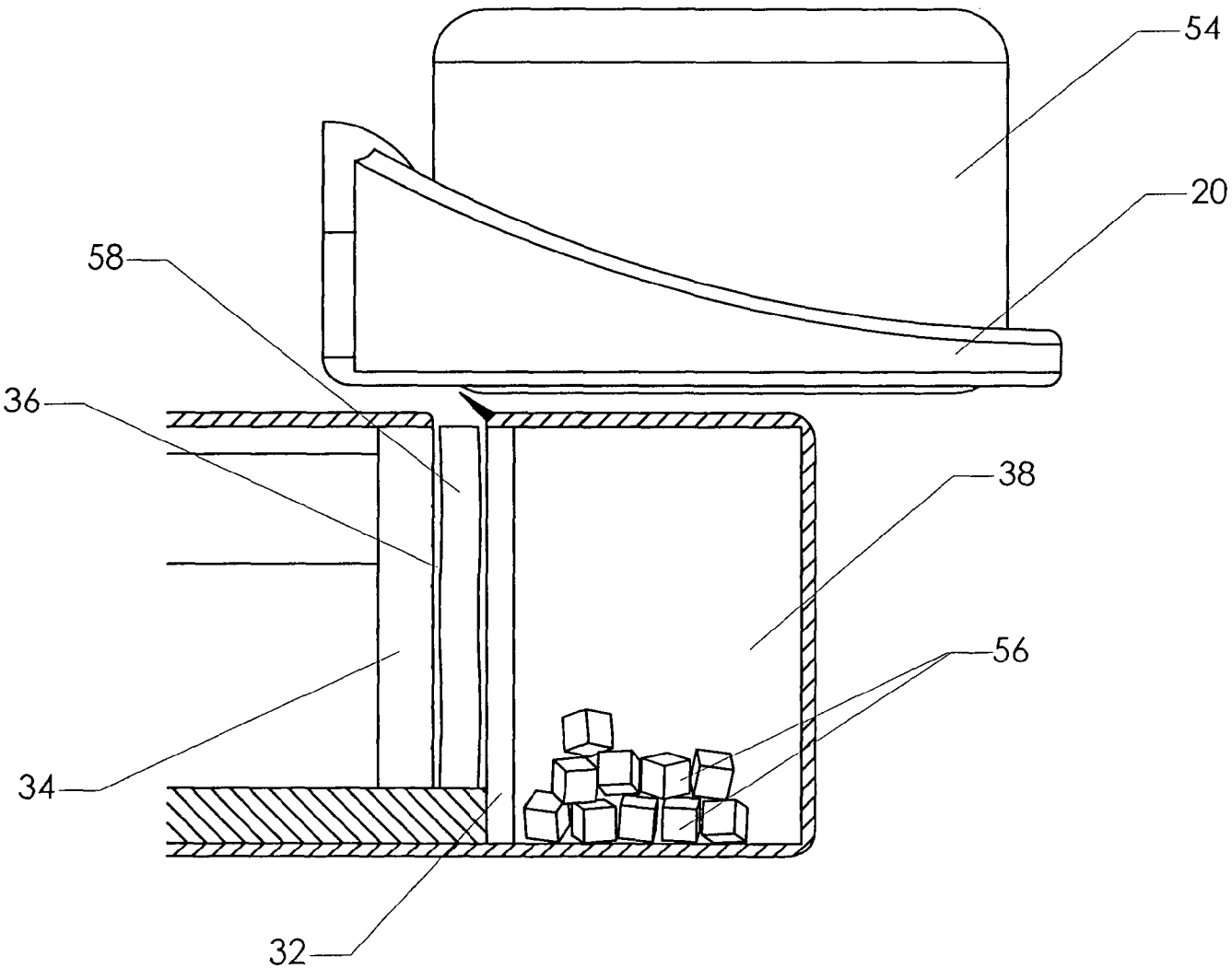
FIG. 8 is a section view, showing the present invention in use.
Figure 9:
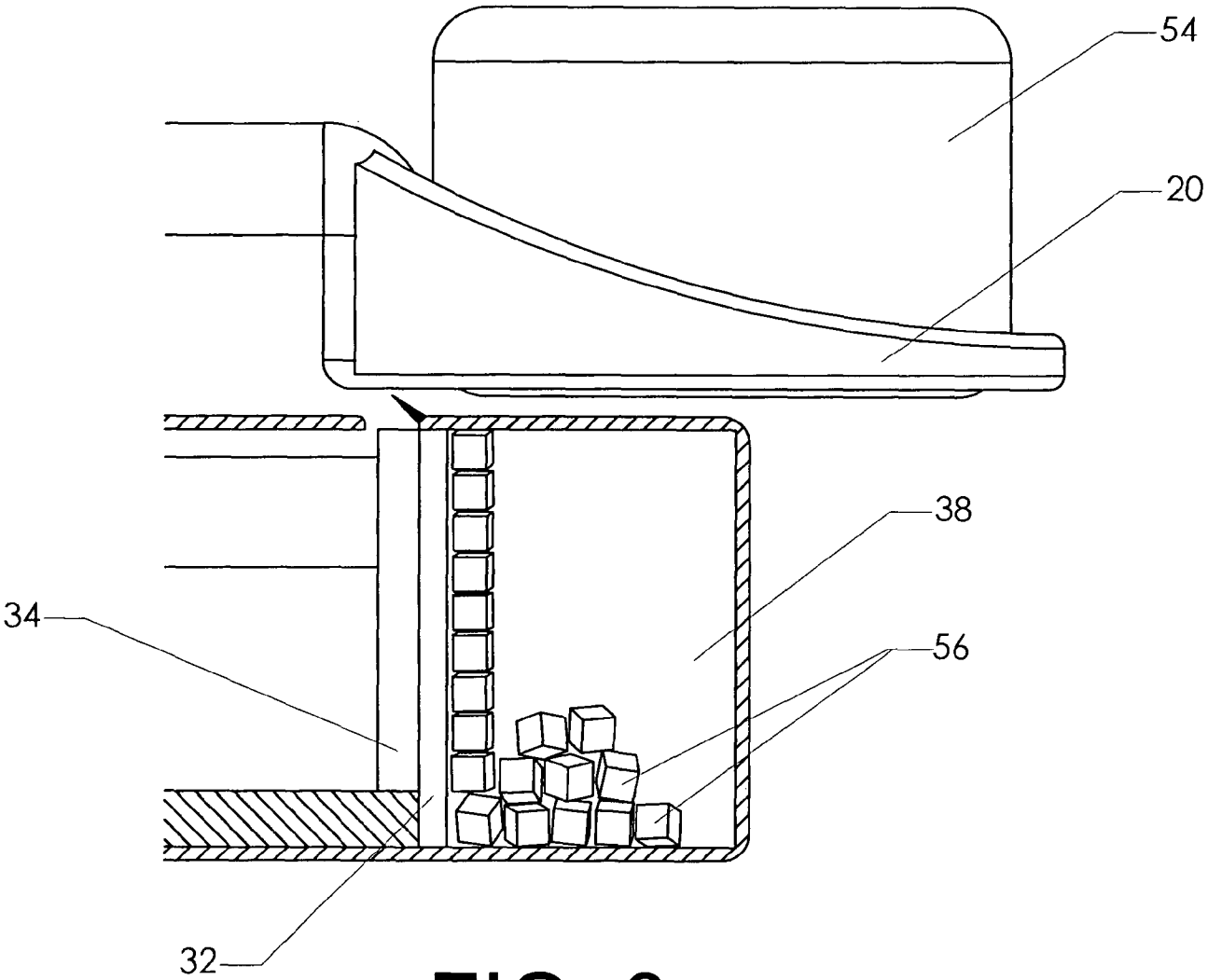
FIG. 9 is a section view, showing the present invention in use.

The operation of the device is better illustrated in FIGS. 7 through 9. With reference to FIG. 7, block 54 is situated in food cradle 24. As block 54 moves across principal cutting blade 28, sliced product 58 is fed through process slot 26 into collapsing bin 36 in front of dicing card 32. Once block 54 travels completely across principal cutting blade 28, sliced product 58 is caught between ram 34 and dicing card 32 as shown in FIG. 8. At this point, collapsing bin 36 is approximately the same width as process slot 26. Those that are skilled in the art will understand that ram 34 can be configured to trail food cradle 20 at a short enough distance to allow ram 34 to "catch" sliced product 58 immediately after being sliced off by principal cutting blade 28, thereby preventing sliced product 58 from folding over on itself. Sliced product 58 is then pushed through dicing card 32 as ram 34 moves through the remainder of collapsing bin 36 as illustrated in FIG. 9. Processed product 56, which is formed by sliced product 58 being pushed through the secondary cutting means, is then received in receiving bin 38.

Figure 10:
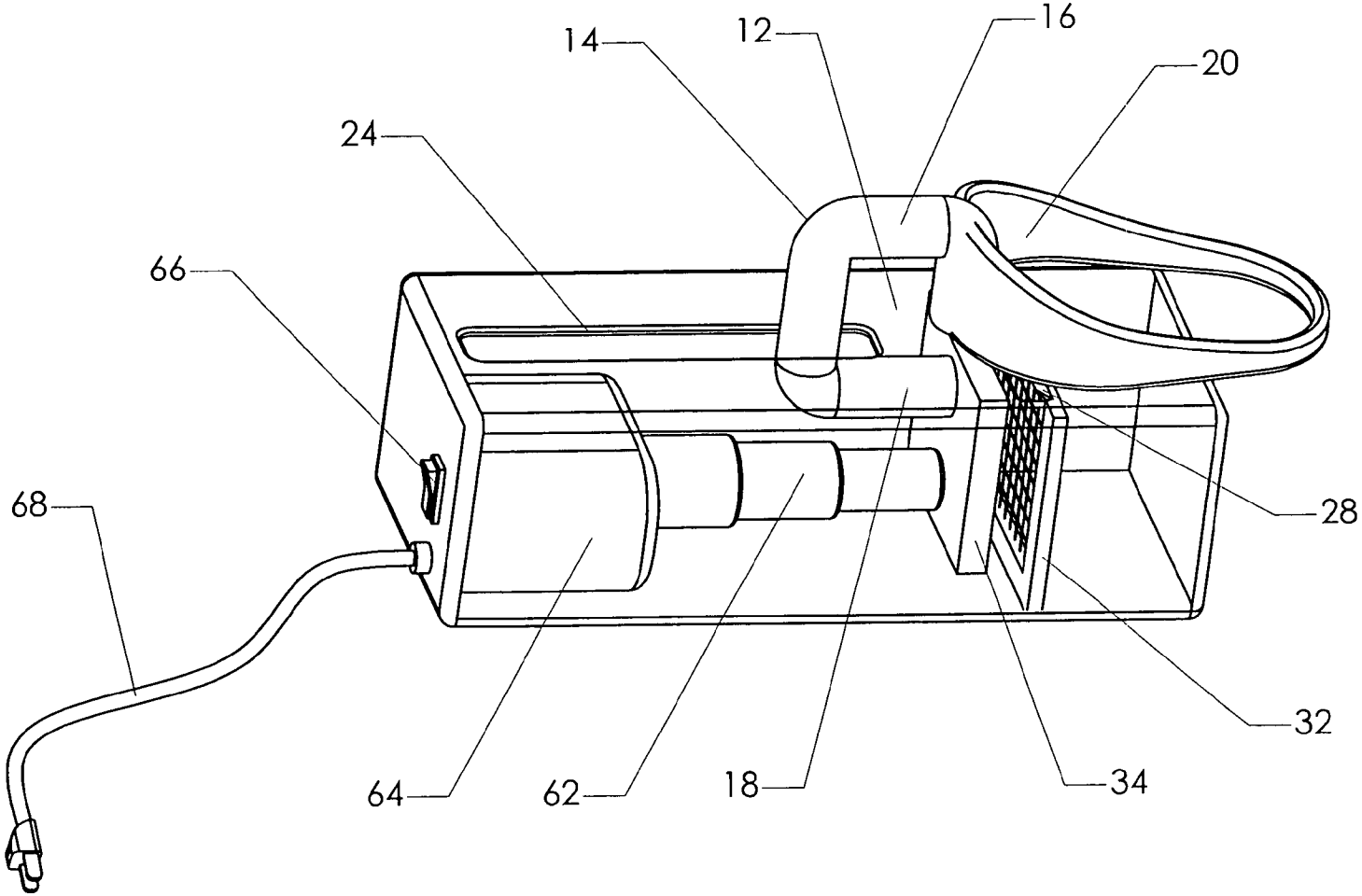
FIG. 10 is a perspective view, showing an alternate embodiment of the present invention.

The movement of gliding body 14 with respect to cutting box 12 can also be automated so that the operator does not have to manually push and pull handle 22. One possible configuration of an automated food processing device is shown in FIG. 10. This configuration utilizes an electronic motor situated within motor housing 64 to drive motor shaft 62 toward and away from dicing card 32. Electrical plug 68 may be provided so that the food processing device can be plugged into any standard electrical outlet. Switch 66 enables the user to activate and deactivate the motor.

Although many configurations and gearings may be used to orchestrate the movement of motor shaft 62, one possible configuration uses an electronic switch to reverse the direction of the motor or change the gearing when motor shaft 62 has fully elongated with respect to motor housing 64 and the sliced product has been pressed through dicing card 32. Another electronic switch can reverse the direction of the motor again or change the gearing back when motor shaft 62 has returned to the unextended state.

In addition, a hydraulic press may also be used in place of the motor to move motor shaft 62 back and forth with respect to dicing card 32. Other mechanical devices may similarly be used as an automation means to create the reciprocating motion.

The preceding description contains significant detail regarding the novel aspects of the present invention. It should not be construed, however, as limiting the scope of the invention but rather as providing illustrations of the preferred embodiments of the invention. As an example, many different means could be provided to enable food cradle 20 to travel across cutting box 12. For example, food cradle 20 could also be mechanically attached to the top of cutting box 12 by tracks. Such a variation would not alter the function of the invention. Thus, the scope of the invention should be fixed by the following claims, rather than by the examples given.

I claim:

1. A food processing device for processing food comprising:

a. a food cradle for holding said food;

b. a primary cutting blade, configured to slice off a portion of said food;

c. a first means for enabling said food cradle to travel towards said primary cutting blade;

d. a secondary cutting blade for further processing said portion of said food sliced off by said primary cutting blade;

e. a second means for enabling said portion of said food sliced off by said primary cutting blade to travel towards said secondary cutting blade, said second means including an arm and a ram, said arm having a first end and a second end, said first end connecting said arm to said first means, and said ram attached to said second end of said arm;

f. wherein said ram of said second means is positioned below and follows behind in motion of said cradle so that said portion of said food sliced off by said primary cutting blade falls in front of said ram of said second means after said portion of said food is sliced off by said primary cutting blade;

g. wherein said food cradle is fixably positioned ahead of said ram of said second means; and h. a cutting box, said cutting box including:

i. a top, said top having a first side and a second side;

ii. a bottom;

iii. a hollow interior situated between said top and said bottom;

iv. wherein said second side of said top faces said hollow interior; and v. wherein said food cradle and said primary cutting blade are positioned on said first side of said top of said cutting box, and said second means is positioned in said hollow interior of said cutting box.

2. A food processing device for processing food comprising:

a. a food cradle for holding said food;

b. a primary cutting blade, configured to slice off a portion of said food;

c. a first means for enabling said food cradle to travel towards said primary cutting blade;

d. a secondary cutting blade for further processing said portion of said food sliced off by said primary cutting blade;

e. a second means for enabling said portion of said food sliced off by said primary cutting blade to travel towards said secondary cutting blade; and f. a cutting box, said cutting box including i. a top, said top having a first side and a second side;

ii. a bottom;

iii. a hollow interior situated between said top and said bottom;

iv. a gliding slot in said top of said cutting box through which said first means is attached to said second means thereby allowing said first means and said second means to travel together in unison v. wherein said second side of said top faces said hollow interior;

g. wherein said food cradle and said primary cutting blade are positioned on said first side of said top of said cutting box, and said second means is positioned in said interior of said cutting box, and wherein said ram of said second means is positioned below and follows behind in motion of said cradle so that said portion of said food sliced off by said primary cutting blade falls in front of said ram of said second means after said portion of said food is sliced off by said primary cutting blade; and h. wherein said food cradle is fixably positioned ahead of said second means.

3. The food processing device of claim 2, said cutting box further comprising a process slot in said top, said process slot configured to receive said portion of said food when said portion of food is sliced off by said primary cutting blade.

4. The food processing device of claim 2, further comprising a cutting card, said cutting card comprising a frame and a first plurality of cutting blades mounted in said frame, said cutting card configured to removably mount within said interior of said cutting box.

5. The food processing device of claim 4, wherein said first plurality of cutting blades are positioned in substantially parallel orientation with respect to each other.

6. The food processing device of claim 5, further comprising a second plurality of cutting blades, said second plurality of cutting blades positioned in substantially parallel orientation with respect to each other and in substantially perpendicular orientation with respect to said first plurality of cutting blades.

* * * * *